US006140605A

United States Patent [19]

Stengel

[11] Patent Number: 6,140,605

[45] Date of Patent: Oct. 31, 2000

[54] METHOD AND DEVICE FOR TREATING THE SURFACES OF COMPONENT BORES

[75] Inventor: Edgar Stengel, Remscheid, Germany

[73] Assignee: Elotherm GmbH, Remscheid, Germany

[21] Appl. No.: 09/381,316

[22] PCT Filed: Jan. 27, 1998

[86] PCT No.: PCT/EP98/00436

§ 371 Date: Oct. 12, 1999

§ 102(e) Date: Oct. 12, 1999

[87] PCT Pub. No.: WO98/41356

PCT Pub. Date: Sep. 24, 1998

[51] Int. Cl.[7] ..... B23K 26/08; C21D 1/00; F02F 1/00

[52] U.S. Cl. ..... 219/121.74; 219/121.82

[58] Field of Search ..... 219/121.6, 121.65, 219/121.66, 121.73, 121.74, 121.82, 121.85

[56] References Cited

U.S. PATENT DOCUMENTS

| | | | |
|---|---|---|---|
| 4,017,708 | 4/1977 | Engel et al. . | |
| 4,365,136 | 12/1982 | Gottlieb | 219/121.65 |
| 4,543,463 | 9/1985 | Scuricini | 219/121.68 |
| 5,719,373 | 2/1998 | Snyder et al. | 219/121.65 |

FOREIGN PATENT DOCUMENTS

| | | |
|---|---|---|
| 2743992 | 4/1978 | Germany . |
| 56-005923 | 1/1981 | Japan . |
| 56-62916 | 5/1981 | Japan . |
| 57-185927 | 11/1982 | Japan . |
| 58-77522 | 5/1983 | Japan . |

*Primary Examiner*—Samuel M. Heinrich
*Attorney, Agent, or Firm*—Proskauer Rose LLP

[57] ABSTRACT

The invention relates to a method for treating the surfaces (I) of bore holes in components, in particular for treating the running paths (I) of cylinder bores (B1, B2, B3, B4) in engine blocks (M) by means of a laser beam (X) which is directed by deviation optics (100) to the surface (I) to be treated; and to a device suitable for the same treatment purpose which allows the treatment of surfaces of component bore holes with increased precision and with improved efficiency at low expenditure. The method according to the invention is characterised in that during the treatment process the component (M) is rotated around an axis of rotation aligned parallel to the longitudinal axis of the bore hole to be treated, with the deviation optics (100) being stationary; and in that unbalanced masses occurring during rotation of the component (M) are balanced by balancing masses (21, 22).

13 Claims, 5 Drawing Sheets

METHOD AND DEVICE FOR TREATING THE SURFACES OF COMPONENT BORES

Figure 1:
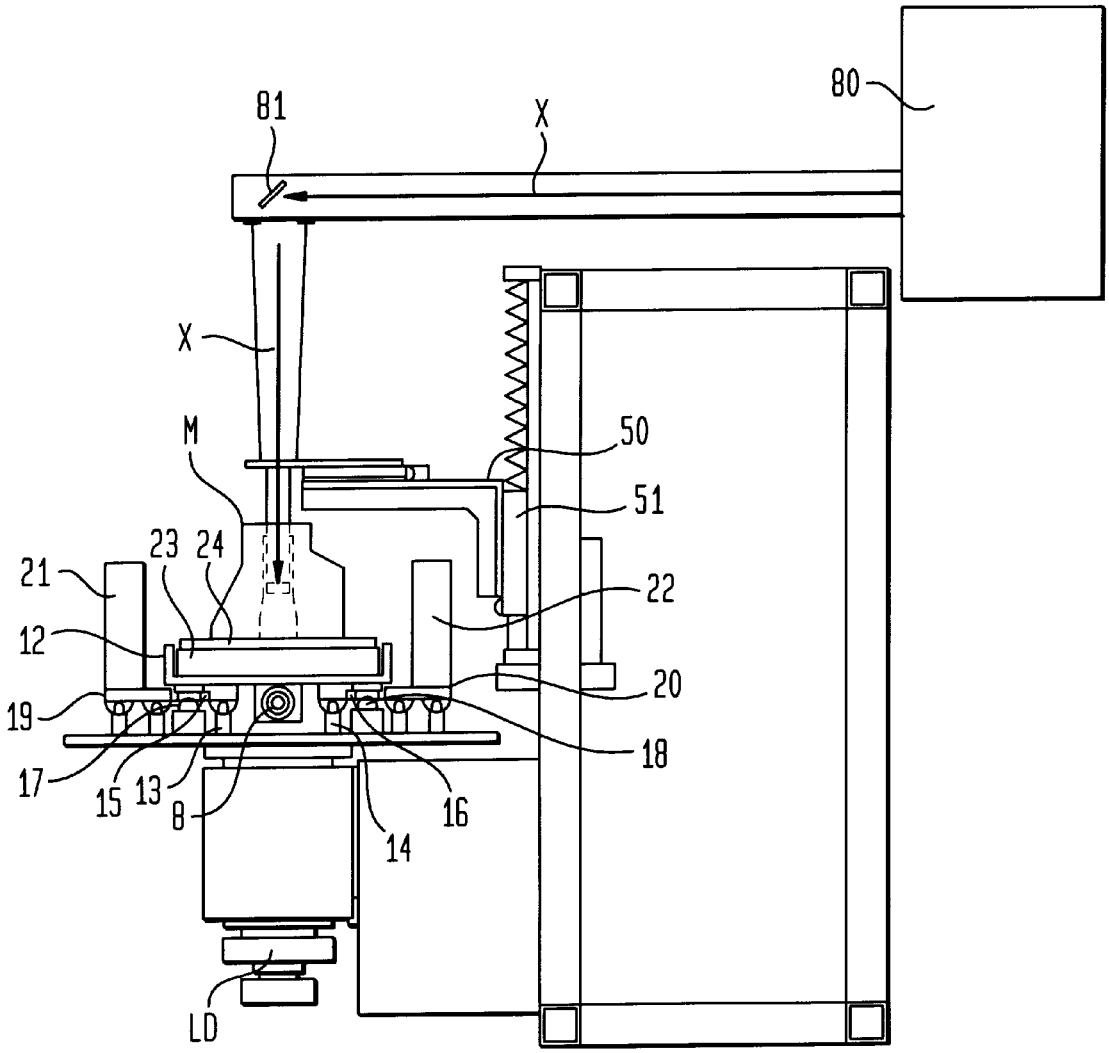

The invention relates to a method and a device for treating the surfaces of bore holes in components, in particular for treating the running paths of cylinder bores in engine blocks by means of a laser beam which is directed by deviation optics to the surface to be treated.

For surface treatment of heavily loaded surfaces of bore holes, in particular for treatment of the running surfaces of cylinder bores of internal combustion engines, devices are used which heat up the running path to be treated by laser beams with a high energy density. The incidence of the laser beam into the bore hole is coaxial to the axis of rotation of the deviation optics, said axis of rotation coinciding with the longitudinal axis of the bore hole. By means of a rotating mirror, the laser beam is deflected in the deviation optics and projected towards the surface to be treated.

In the case of the known treatment stations, due to their small size and light weight, the deviation optics can be rotated without any problems at high rotational speeds. Depending on the number of rotations completed, during treatment the deviation optics are inserted progressively deeper into the bore hole via suitable linear drives, until treatment is completed. Following this, the deviation optics are withdrawn from the bore hole and moved to the subsequently to be treated bore hole by a further linear drive.

The advantage of the known treatment station is due to the light weight of its deviation optics. This makes it possible when treating bore hole surfaces, to move only small masses. Accordingly, only low centrifugal forces have to be overcome during treatment of the surfaces. Furthermore, the high rotational speed of the deviation optics results in effective and even treatment of the bore hole surfaces. The light weight also enables easy advance with little expenditure of energy, of the deviation optic to the bore hole to be treated next. Due to these two known advantages of the known treatment stations, the said stations can be compact and low cost and can thus be produced more economically.

However, practical use has shown that the known treatment stations can only be operated at low efficiency. Due to the confined space and the necessity of arranging the deviation mirror of the deviation optics on its axis of rotation, only a fraction of the laser beam actually reaches the surface to be treated.

Apart from the above-mentioned state of the art known from practical experience, Patent Abstracts of Japan, C-50, 1981, vol. 5, no. 54, JP 56-5923 A discloses a device wherein for heat treatment of the surfaces of bore holes in cylindrical components by means of a laser beam, which is directed to the surface to be treated by way of deviation optics, during treatment the cylindrical component is rotated around an axis of rotation parallel to the longitudinal axis of the bore hole to be treated, with the deviation optics being stationary.

It is the object of the invention to provide a method and a device which with little expenditure allows the treatment of surfaces of component bore holes with increased precision and with improved efficiency. Concerning a method of the type described in the introduction, this object is met in that during the treatment process, the component is rotated around an axis of rotation aligned parallel to the longitudinal axis of the bore hole to be treated, with the deviation optics being stationary; and in that unbalanced masses occurring during rotation of the component are balanced by balancing masses. Preferably the axis of rotation of the component should coincide with the axis of rotation of the bore hole to be treated.

This object is also met by a device for treating the surfaces of bore holes in components, in particular for treating the running paths of cylinder bores in engine blocks, by means of a laser beam, comprising deviation optics insertable into the bore holes to be treated, for deviating the laser beam onto the surface to be treated; a turntable drive for rotating the component around an axis of rotation arranged parallel to the longitudinal axis of the respective bore hole to be treated and arranged within the bore aperture, and with at least one balancing mass which are able to be coupled to the turntable drive for balancing unbalanced masses which occur during rotation of the component.

According to the invention it is proposed that the component as a whole be rotated around an axis of rotation which is arranged in the bore hole to be treated, with the deviation optics for the laser being stationary. At the same time, the unbalanced masses caused by rotating the components are balanced by suitably arranged balancing masses. In this way quiet, troublefree rotation of the component during treatment is insured in spite of the significant centrifugal forces occurring during rotation of the component.

In spite of the increased expenditure of a device according to the invention, for the drive of the component; in spite of the necessity of high drive forces in particular when treating larger heavier components such as engine blocks; and in spite of the significant centrifugal forces to be balanced when rotating heavy components, surprisingly, considerably improved results are achieved in comparison to the conventional treatment method. This is possible in that the deviation optics which are stationary during treatment, are decoupled from the vibrations of the rotational movement of the component, so that the laser beam can be projected with high precision onto the surface to be treated, unaffected by housing oscillations.

The precision of projection of the laser beam onto the surface to be treated can be additionally improved in that the centre of the laser beam projected into the bore hole is spaced apart from the longitudinal axis of the bore hole. It is thus possible to arrange the deviation mirror of the deviation optics at a greater distance to the surface to be treated. As a result of the associated increase in focal length, an improvement in projection accuracy of the laser beam is achieved.

In particular when treating components of complex shape, it is favourable if a control device is provided which, depending on the unbalanced mass occurring during rotation of a component, issues control signals to regulating devices for changing the position and/or the weight of the balancing mass. With such a control device, unbalanced masses during rotation of the component can be balanced automatically.

Balancing of the unbalanced mass can also occur in an economic way in that, forced by mechanical coupling, a change in position of the component results in a corresponding change in the position of the balancing mass for balancing the unbalanced mass caused by the change in position of the component. A device according to the invention arranged in such a way ensures that any change in position of the component which results in unbalanced mass, results in a corresponding change in the position of the balancing mass so as to balance the unbalanced mass. Such mechanical coupling of the movement can be achieved simply in that the component is attachable to a first slide movable along a first linear movement path; that the balancing mass is movable along a second movement path aligned parallel to the first movement path; and that the movement of the first slide is coupled to the movement of the balancing mass by way of a rack and pinion gear. Such an embodiment of the invention is particularly advantageous if the bore holes to be treated, such as for example the cylinder bores of an engine block, are arranged in line. In this context it is also favourable if there are at least two balancing masses with in each instance a movement path for one of the balancing masses being arranged in the region of one side of the slide, and the movement path of the other balancing mass being arranged on the opposite side of the slide. In this way, several balancing masses of small dimensions and small individual weights can be attached in a space-saving way to the device according to the invention.

A practical embodiment of a device according to the invention, which embodiment operates at high precision, is characterised in that the slide carrying the component is arranged on a turntable driven by a main turntable drive; that the slide is coupled to a drive shaft by means of a gear which converts the rotary movement of said drive shaft coupled to the main turntable drive to a linear movement of the slide; and that there is an intermediate gear by means of which by introducing an additional turntable drive movement, a difference in rotational speed between the turntable and the drive shaft can be generated. A device configured in this way makes it possible to adjust the slide carrying the component along a linear movement path while the component is rotating. No interruption of the rotation for repositioning the component after treatment of a bore hole is required, consequently no work time is lost for braking and restarting the turntable.

It is favourable if the deviation optics comprise a housing insertable into the bore hole into which the laser beam is projected so as to be offset in relation to the longitudinal axis; and comprise a deviation mirror arranged in the housing in the path of incidence of the laser beam, said deviation mirror deflecting said laser beam to an exit aperture provided in the case surface of the housing. Such an embodiment of the deviation optics makes it possible to precisely project the laser beam onto the surface to be treated at maximum focal length.

The invention provides a significant advantage in that due to the position of the laser beam being offset in relation to the longitudinal axis of the bore hole to be treated, it is possible in a simple way, in the region of the deviation optics, to provide adequate space for removal by suction of the gasses resulting from treatment of the surfaces of the bore hole. In this way, the deviation optics can be kept clean and any negative influence on the treatment result caused by the settling of previously removed particles can be prevented.

Figure 2:
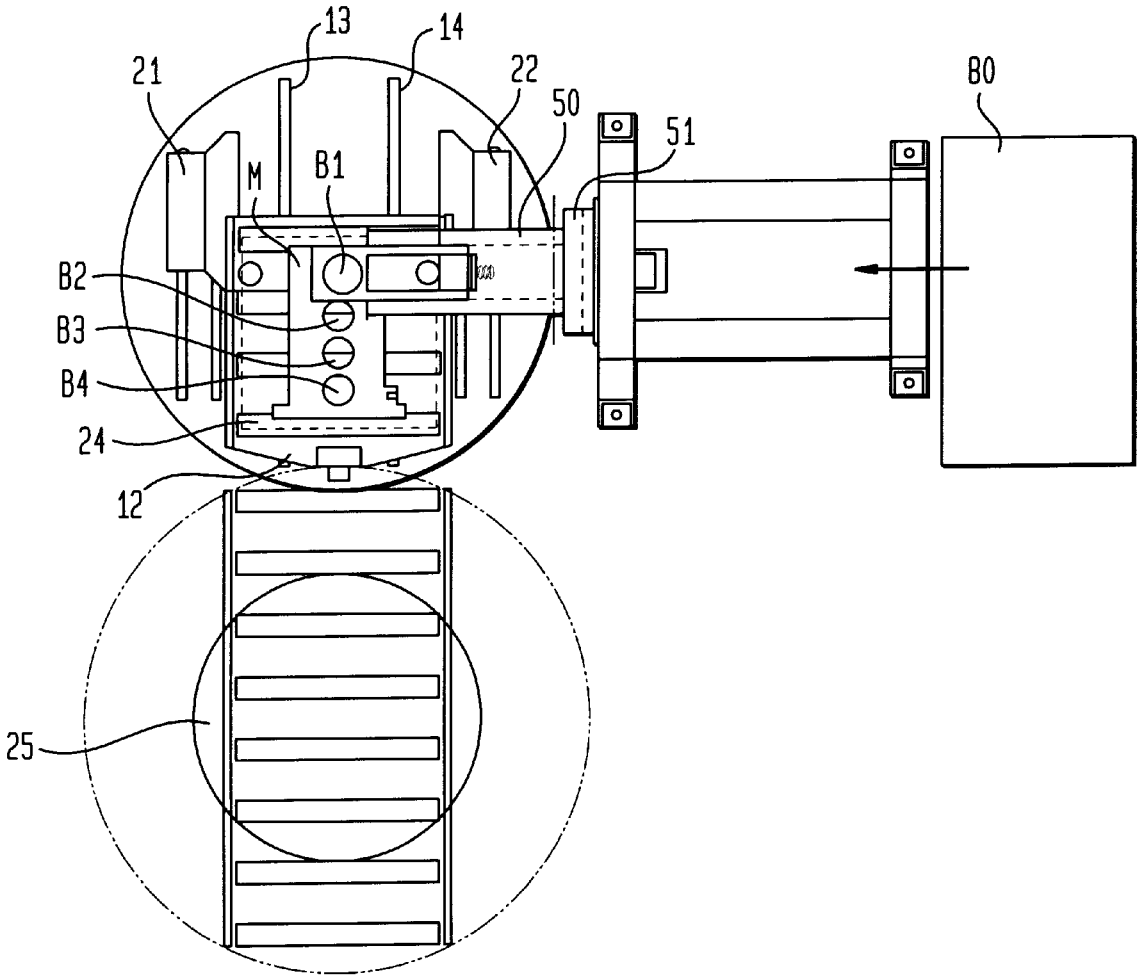
Figure 3:
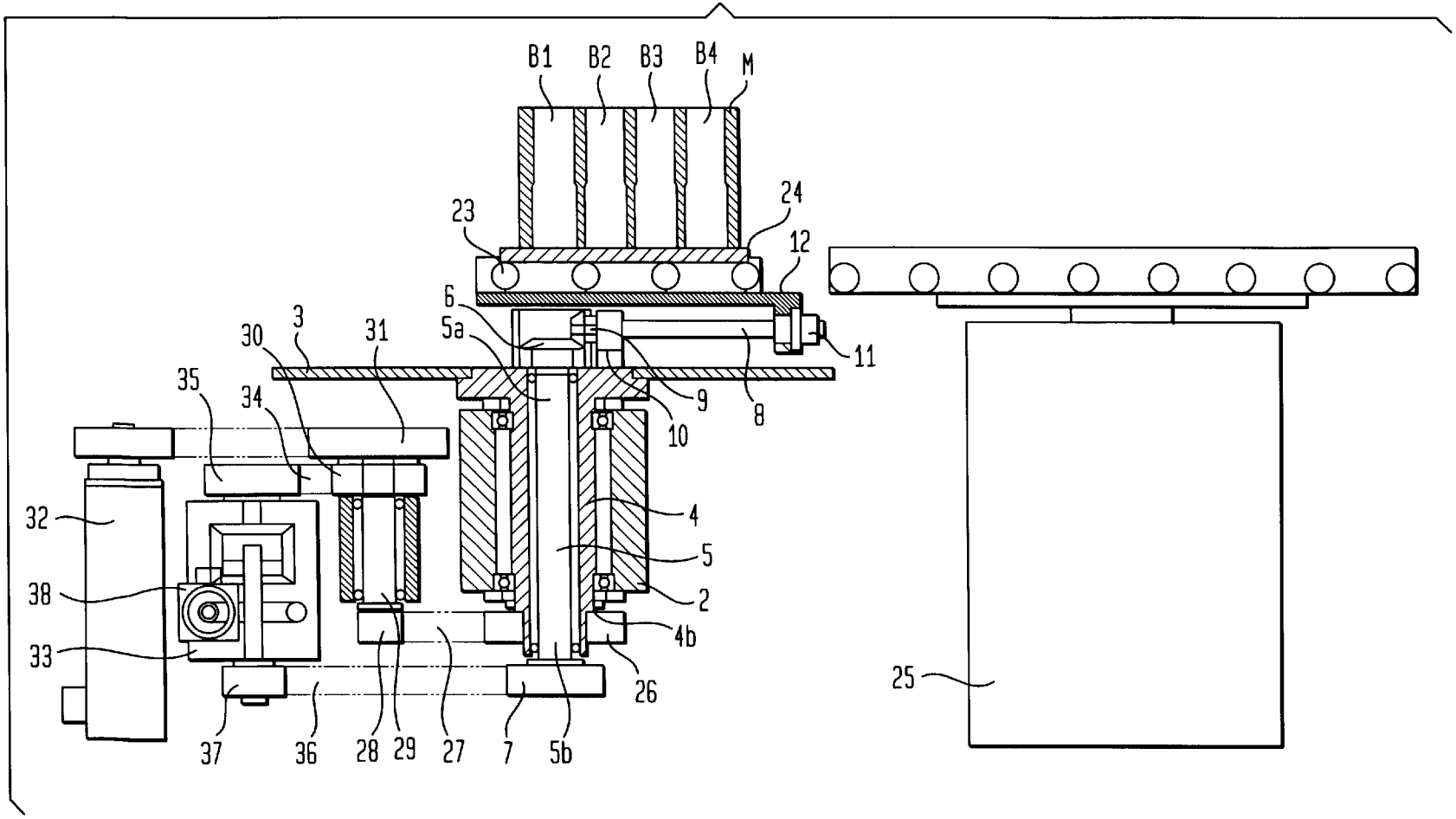
Figure 4:
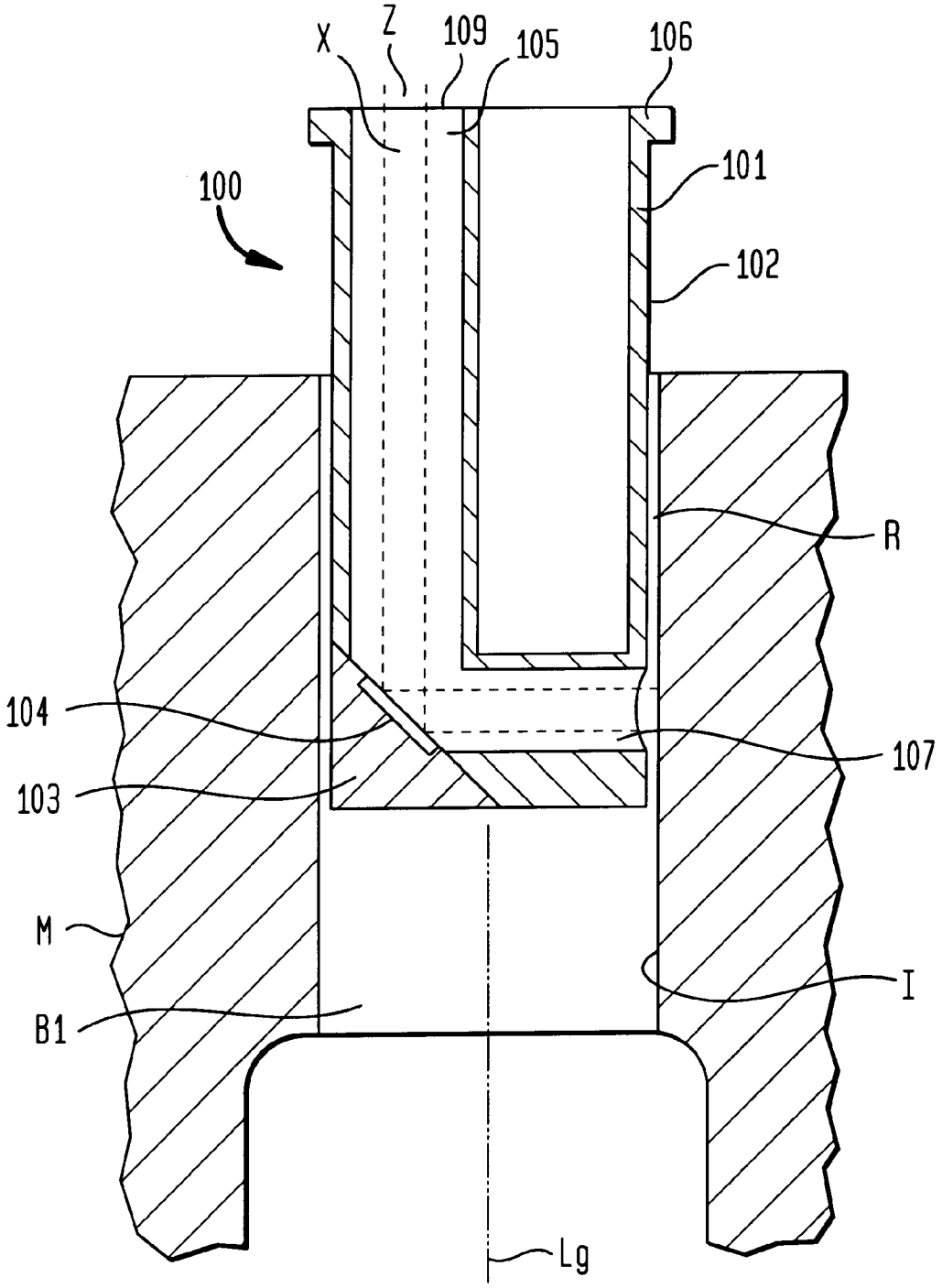
Figure 5:
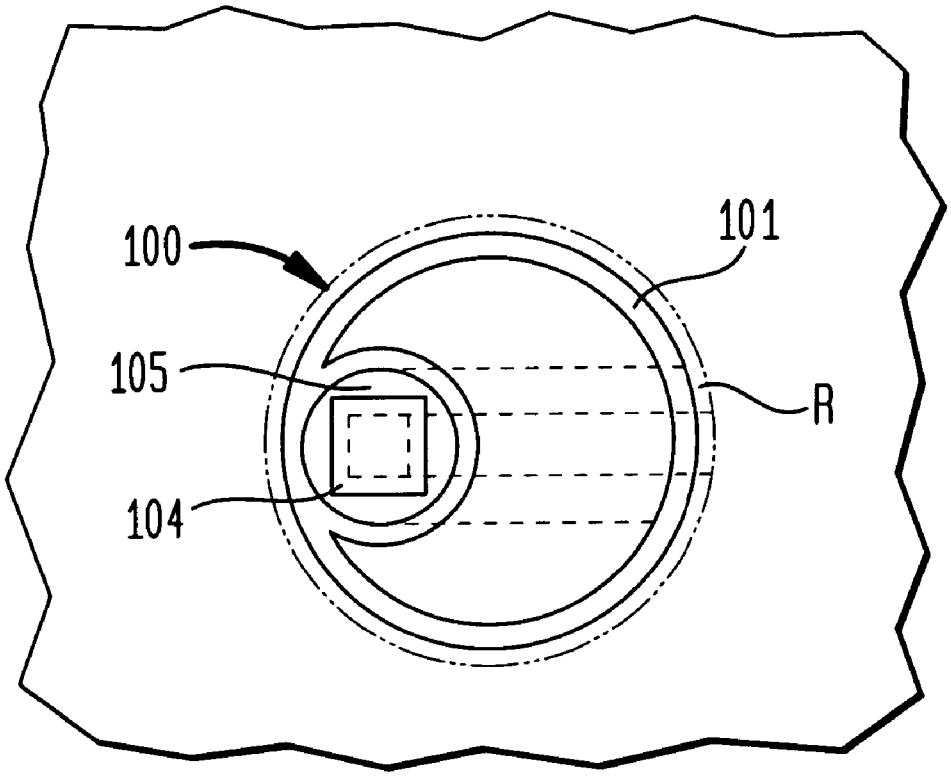

Below, the invention is illustrated in more detail by means of a drawing showing one embodiment. The following are shown in diagrammatic view:

FIG. 1 a lateral view of a device for treating the running surfaces of cylinder bores in an engine block;

FIG. 2 a top view of a device according to FIG. 1;

FIG. 3 a frontal, part-sectional view of the device according to FIGS. 1 and 2;

FIG. 4 a partial sectional longitudinal view of the deviation optics, intended for use in the device according to FIGS. 1 to 3, inserted into a bore hole; and FIG. 5 a top view of the deviation optics shown in FIG. 4.

The device 1 shown in FIGS. 1 to 3 comprises a mount 2 in which a hollow shaft 4 carrying a turntable 3 is retained. A drive shaft 5 runs on bearings inside the hollow shaft 5, with the ends 5*a, b* of said shaft protruding from the upper end of the hollow shaft 4 associated with the turntable 3, or the lower end 4*b* of the hollow shaft 4. At the upper end 5*a* of the drive shaft 5 there is a conical gear wheel 6, and at the lower end 5*b* of said drive shaft there is a pulley 7 attached.

The conical gear wheel 6 attached to the drive shaft 5 interacts with a conical gear wheel 9 attached to a threaded spindle 8 aligned at a right angle to the drive shaft 5. The end section of the threaded spindle 8 associated with the drive shaft 5 runs on a bearing 10 supported by the turntable 3. A slide 12 is coupled to the threaded spindle 8 by way of a threaded piece 11.

The slide 12 is slidably retained by parallel straight guide rails 13, 14 attached to the turntable 3. Associated with the respective guide rails 13, 14, there are toothed racks 15, 16 on the underside of the slide 12. The teeth of said toothed racks 15, 16 point towards the nearest edge of the slide 12. Respective cogs 17, 18 running on bearings on the turntable 3 interact with the toothed racks 15, 16. In addition a respective toothed rack interacts with the cogs 17, 18, said toothed racks being formed by the lateral edge associated with the slide 12 of a further slide 19, 20 arranged parallel to the slide 12. Each of the slides 19, 20 carries a balancing mass 21, 22, whose weight corresponds to half the weight of a motor M borne by the slide 12. By way of the toothed racks 15, 16, the cogs 17, 18 and the toothed racks of the slide 19, 20, each movement of the slide 12 in one direction causes a respective repositioning of the slides 19, 20 in the opposite direction.

On its top, the slide 12 comprises rollers 23 arranged axially parallel to each other by way of which a transport pallet 24 carrying the engine block M is slidable onto the slide 12 by means of a loading and unloading device 25. In the position shown in the figures, the engine block M is fixed to the slide 12 together with the transport pallet 24.

On the lower end of the hollow shaft 2 there is also a pulley 26 attached, with a belt 27 in place. This belt 27 connects the hollow shaft 4 with a pulley 28 which is attached to the lower shaft end of an intermediate shaft 29 retained in the mount 2. At its upper end, the intermediate shaft 29 carries two pulleys 30, 31. The intermediate shaft 29 is connected to a main drive 32 by way of the upper pulley 31.

Via the other pulley 30, by means of a belt 34, a pulley 35 attached to an input shaft of an intermediate gear 33 is connected to the intermediate shaft 29. A belt 36 connects a pulley 37 borne by an output shaft of the intermediate gear 33 with the pulley 7 of the drive shaft 5 so that the drive shaft 5 is connected to the main drive 32 by way of the intermediate gear 33 and the intermediate shaft 29.

By means of an additional drive motor 38 interacting with the intermediate gear 33, an additional rotary movement can be introduced to the drive train for the drive shaft 5, said drive train being formed by the belt 35, the pulley 34, the intermediate drive 33, the pulley 37 and the belt 36. This rotational movement can be in the same direction as the direction of rotation of the turntable 3 or it can be in the opposite direction.

The diameters of the pulleys 7, 26, 28, 30, 31, 34, 36 are matched to each other in such a way that with the additional drive motor 38 switched off, the shaft 5 rotates at the same speed as the turntable 3 borne by the hollow shaft 4. If the additional drive motor 38 introduces a rotary movement, in the same direction as that of the turntable, to the drive train for the drive shaft 5, said drive shaft 5 rotates at higher speed than that of turntable 3. This results in the threaded spindle 8 starting to rotate at a speed corresponding to the difference in rotational speed between the turntable 3 and the drive shaft 5. In this way, the slide 12 is moved along the guide rails 13, 14 on a linear movement track. By contrast if by way of the intermediate drive 33 a rotation opposite the rotational direction of the turntable 3 is introduced into the drive train for the drive shaft 5, then said drive shaft 5 rotates correspondingly more slowly than the turntable 3 so that the threaded spindle 8 starts turning in the opposite direction. Accordingly, the slide 12 is moved in the opposite direction to the direction previously described.

The deviation optics 100 shown in FIGS. 4 and 5 comprise a cylindrical, pot-shaped housing 101. The diameter of the housing is smaller than the diameter of the bore holes B1, B2, B3, B4 to be treated, of the engine block M. Thus with the deviation optics 100 inserted into the bore hole coaxially, there is an annular gap R between the interior surface I and the case surface 102 of the housing 101.

The deviation optics 100 are fixed to the free end of a boom 50 of a regulating device 51 operating in vertical direction, with the length of said regulating device being such that the longitudinal axis Lg of the deviation optics 100 is aligned coaxially to the axis of rotation LD of the turntable 3.

In the area of the transition between its case surface 102 and its bottom, the housing 101 comprises a recess into which a mirror insert 103 of prismatic cross-section is inserted. The mirror surface 104 of the mirror insert 103 associated with the inner side of the housing 101 is aligned at an angle of 45° to the longitudinal axis Lg of the housing 101, with the centre of the mirror surface 104 being arranged so as to be offset, in respect to the longitudinal axis Lg, by a quarter of the housing diameter.

Within the housing 101 there is a channel 105 with a diameter larger than the diameter of the mirror surface 104, said channel being arranged concentrically to said mirror surface 104 and above it. The entrance aperture 109 of the channel 105 is located on the upper rim 106 of the housing 101.

The case surface 102 of the housing 101 comprises an aperture 107. The aperture 107 is arranged concentrically to an imaginary straight line arranged in a plane normally aligned along the longitudinal axis Lg intersecting the centre of the mirror surface and, seen from above, meeting the mirror surface 104 at a right angle.

For treatment of the interior surface I of one of the bore holes B1, B2, B3, B4 arranged one behind the other of the motor M, while the turntable is rotating and while the motor M is rotating with the turntable 3, the deviation optics 100 are lowered, by means of the regulating device 51 into the bore hole B1 to be treated, up to the starting position of the section to be treated of the interior surface I. Subsequently, a device 80 for generating a laser beam X is switched on. The laser beam X which at first is aligned at a right angle to the longitudinal axis Lg of the housing 101 is deflected via a suitable deviation mirror 81 such that it reaches the housing 101 as a beam aligned parallel to the longitudinal axis Lg of the deviation optics 100 but at a distance to said deviation optics 100. Its centre Z is concentrically aligned in respect to the mouth of the channel 105 of the deviation optics 100. The laser beam X reaching the housing of the deviation optics 100 through the channel 105 is projected onto the mirror surface 104 which deflects it at a right angle to the aperture 107 of the housing 101. The laser beam X leaves the deviation optics 100 by way of this aperture 107 and reaches the rotating interior surface I to be treated.

The heating up of the interior surface I caused by the laser beam X results in evaporation of particles adhering to the interior surface. The resulting gases are removed by suction by way of the annular gap R formed between the housing 101 of the deviation optics 100 and the interior surface I of the bore hole B1, and additionally by way of the cross sections which are not taken up by the channel 105 and its walls.

Depending on the progress of treatment, the deviation optics 100 are lowered into the bore hole B1 until the end of the section of the interior surface I to be treated is reached. Now the deviation optics 100 are removed from the bore hole B1. While the turntable 3 continues to rotate in the way described above, subsequently the slide 12 is moved in a linear direction by introducing an additional drive movement into the drive train for the drive shaft 5, until the longitudinal axis of the subsequently to be treated bore hole B2 is aligned coaxially to the longitudinal axis Lg of the deviation optics 100. Due to the coupling, caused by the toothed racks 15, 16, the cogs 17, 18, and the toothed racks of the slides 19, 20, of the movements of the slide 12 carrying the motor M with the slide s 19, 20 carrying the balancing masses 21, 22, said balancing masses 21, 22 are always in a position in which the balancing masses 21, 22 balance the unbalanced mass caused by the rotating motor M.

What is claimed is:

1. A method for treating surfaces of bore holes in components by means of a laser beam which is directed by deviation optics to the surface to be treated, wherein during the treatment process, the component is rotated around an axis of rotation aligned parallel to the longitudinal axis of the bore hole to be treated, wherein the deviation optics are stationary, and wherein unbalanced masses occurring during rotation of the component are balanced by balancing masses.

2. The method of claim 1 wherein the holes are running paths of cylinder bores in engine blocks.

3. The method of claim 1 wherein the axis of rotation of the component coincides with the longitudinal axis of the bore holes to be treated.

4. The method of claim 1 wherein the center of the laser beam projected into the bore holes is spaced apart from the longitudinal axis of the bore holes.

5. A device for treating surfaces of bore holes in components by means of a laser beam comprising:

deviation optics insertable into the bore holes to be treated for deviating the laser beam onto the surface to be treated, a turntable drive for rotating the component around an axis of rotation arranged parallel to the longitudinal axis of the respective bore holes to be treated and arranged within the bore holes, and at least one balancing mass which is able to be coupled to the turntable drive for balancing unbalanced masses which occur during rotation of the component.

6. The device of claim 5 wherein the holes are running paths of cylinder bores in engine blocks.

7. The device of claim 5 wherein a control device issues control signals to regulating devices for changing at least one of the position and weight of the balancing mass depending on the unbalanced mass occurring during rotation of a component.

8. The device of claim 5 wherein the component is attachable to a first slide movable along a first linear movement path, wherein the balancing mass is movable along a second movement path aligned parallel to the first movement path, and wherein the movement of the first slide is coupled to the movement of the balancing mass by means of a rack and pinion gear.

9. The device of claim 8 wherein there are at least two balancing masses.

10. The device of claim 9 wherein in each instance one movement path for one of the balancing masses is arranged in the region of one side of the slide and the movement path of the other balancing mass is arranged on the opposite side of the slide.

11. The device of claim 8 wherein the slide carrying the component is arranged on a turntable driven by a main turntable drive, wherein the slide is coupled to a drive shaft by means of a gear which converts the rotary movement of the drive shaft coupled to the main turntable drive to a linear movement of the slide, and wherein there is an intermediate gear which introduces an additional turntable drive movement so as to generate a difference in rotational speed between the turntable and the drive shaft.

12. The device of claim 8 wherein the axis of rotation of the component coincides with the longitudinal axis of the bore holes of the component.

13. The device of claim 12 wherein the deviation optics further comprise:

a housing insertable into the bore hole into which the laser beam is projected so as to be offset in relation to the longitudinal axis, and a deviation mirror arranged in the housing in the path of incidence of the laser beam which deflects the laser beam to an exit aperture in the housing.

* * * * *